US005334908A

United States Patent [19]

Zimmerman

[11] Patent Number: 5,334,908

[45] Date of Patent: Aug. 2, 1994

[54] STRUCTURES AND PROCESSES FOR FABRICATING FIELD EMISSION CATHODE TIPS USING SECONDARY CUSP

[75] Inventor: Steven M. Zimmerman, Pleasant Valley, N.Y.

[73] Assignee: International Business Machines Corporation, Armonk, N.Y.

[21] Appl. No.: 996,369

[22] Filed: Dec. 23, 1992

Related U.S. Application Data

[63] Continuation of Ser. No. 887,579, May 19, 1992, abandoned, which is a continuation of Ser. No. 555,213, Jul. 18, 1990, abandoned.

[51] Int. Cl.[5] ..... H01J 1/16

[52] U.S. Cl. ..... 313/336; 313/309; 313/351

[58] Field of Search ..... 313/309, 336, 351

[56] References Cited

U.S. PATENT DOCUMENTS

| | | | |
|---|---|---|---|
| 3,453,478 | 7/1969 | Shoulders et al. | 313/309 |
| 3,497,929 | 3/1970 | Shoulders et al. | 29/25.17 |
| 3,665,241 | 5/1972 | Spindt et al. | 313/351 |
| 3,753,022 | 8/1973 | Fraser, Jr. | 313/78 |
| 3,755,704 | 8/1973 | Spindt et al. | 313/351 |
| 3,855,499 | 12/1974 | Yamada et al. | 313/336 |
| 3,921,022 | 11/1975 | Levine | 313/309 |
| 3,970,887 | 7/1976 | Smith et al. | 313/309 |
| 3,998,678 | 12/1976 | Fukase et al. | 156/3 |

(List continued on next page.)

FOREIGN PATENT DOCUMENTS

| | | |
|---|---|---|
| 2951287 | 7/1981 | Fed. Rep. of Germany . |
| 56-160740 | 3/1982 | Japan . |

OTHER PUBLICATIONS

C. A. Spindt, "A Thin-Film Field-Emission Cathode," J. Appl. Phys., vol. 39, No. 7, pp. 3504–3505 (1968).

G. J. Campisi, et al., "Microfabrication of Field Emission Devices for Vacuum Integrated Circuits Using Orientation Dependent Etching," Material Res. Soc. Symp. Proc. vol. 76, pp. 67–72 (1987).

I. Brodie, "Physical Considerations in Vacuum Microelectronics Devices," IEEE Transactions on Electron Devices, vol. 36, No. 11, pp. 2641–2644 (Nov. 1989).

W. J. Orvis, et al., "Modeling and Fabricating Micro-Cavity Integrated Vacuum Tubes," IEEE Transactions on Electrton Devices, vol. 36, No. 11, pp. 2651–2658 (Nov. 1989).

H. H. Busta, et al., "Field Emission from Tungsten--Clad Silicon Pyramids, " IEEE Transactions on Electron Devices, vol. 36, No. 11, pp. 2679–2685 (Nov. 1989).

R. A. Lee, et al., "Semiconductor Fabrication Technology Applied to Micrometer Valves," IEEE Transactions on Electron Devices, vol. 36, No. 11, pp. 2703–2708 (Nov. 1989).

(List continued on next page.)

*Primary Examiner*—Donald J. Yusko
*Assistant Examiner*—John Giust
*Attorney, Agent, or Firm*—Aziz M. Ahsan

[57] ABSTRACT

The present invention relates generally to new structures for a field emission cathode and processes for fabricating the same. The field emission is made of any material that is capable of emitting electrons under the influence of an electrical potential. The field emission cathode has several unique three dimensional structures. The basic structure comprises of a layer of material with cathode tips. For a more complex structure the cathode tip is preferably accurately aligned inside an extraction/control electrode structure, in preferably a vacuum environment. The structures of this invention can be fabricated to be connected to other similar field emission cathodes or to other electronic devices.

51 Claims, 7 Drawing Sheets

U.S. PATENT DOCUMENTS

| | | | |
|---|---|---|---|
| 4,008,412 | 2/1977 | Yuito et al. | 313/351 |
| 4,307,507 | 12/1981 | Gray et al. | 313/351 |
| 4,338,164 | 7/1982 | Spohr | 204/4 |
| 4,513,308 | 4/1985 | Greene et al. | 357/55 |
| 4,721,885 | 1/1988 | Brodie | 313/576 |
| 4,857,799 | 8/1989 | Spindt et al. | 313/309 |
| 4,889,588 | 12/1989 | Fior | 156/643 |
| 4,964,946 | 10/1990 | Gray et al. | 313/351 |
| 4,983,878 | 1/1991 | Lee et al. | 313/336 |
| 5,007,873 | 4/1991 | Goronkin et al. | 313/309 |
| 5,012,153 | 4/1991 | Atkinson et al. | 313/351 |

OTHER PUBLICATIONS

N. A. Cade, et al., "Wet Etching of Cusp Structures for Field-Emission Devices," IEEE Transactions on Electron Devices, vol. 36, No. 11, pp. 2709-2714 (Nov. 1989).

R. B. Marcus, et al., "Formation of Atomically Sharp Silicon Needles," IEDM, pp. 884-886 (1989).

W. J. Orvis, et al., "A Progress Report on the Livermore Miniature Vacuum Tube Project," IEEE, IEDM, pp., 529-532 (1989).

B. Goodman, "Return of the Vacuum Tube," Discover Magazine, pp. 55-58 (Mar. 1990).

H. H. Busta, et al., "Micromachined Tungsten Field Emitters" Extended Abstracts, No. 1046B, vol. 86, No. 1, pp. 403-404 (May 1986).

G. Lubrunie, et al, "Novel Type of Emissive Flat Panel Display: The Matrixed Cold-Cathode Microtip Fluorescent Display" Displays, pp. 37-40 (Jan. 1987).

STRUCTURES AND PROCESSES FOR FABRICATING FIELD EMISSION CATHODE TIPS USING SECONDARY CUSP

This application is a continuation of Ser. No. 07/887,579, filed May 19, 1992, now abandoned, which is a continuation of Ser. No. 07/555,213, filed Jul. 18, 1990, now abandoned.

FIELD OF THE INVENTION

The present invention relates generally to the structures of individual or arrays of field emission cathodes and a process of fabricating the same. These individual or arrays of field emission cathodes can be made both with or without integrated extraction and/or control electrodes. More specifically, the present invention relates to field emission cathode structures and process for making the same.

CROSS-REFERENCE

This patent application relates to U.S. patent application Ser. No. 07/555,214, filed concurrently on Jul. 18, 1990, now abandoned, the disclosure of which is incorporated herein by reference.

BACKGROUND OF THE INVENTION

Electron sources or cathodes are essential to the functioning of all electron devices. Traditionally, cathodes for vacuum devices such as vacuum tubes and cathode ray tubes used thermionic emission to produce the required electrons. This required raising cathode materials to very high temperatures either by direct conduction of current or through the use of auxiliary heaters. The process is very inefficient, requiring relatively large currents and dissipating most of the energy as wasted heat.

In recent years there has been a growing interest in replacing the inefficient thermionic cathodes with high field emission cathodes. These cathodes are very efficient because they eliminate the need to heat the cathode material. They have been used for a number of years as sources for scanning electron microscopes, and are now being investigated as sources for vacuum microelectronic devices, flat panel displays, and high performance high frequency vacuum tubes.

Field emission-cathodes consists of very sharp points (typically less then 100 nm radius) of field emission materials. These sharp points when biased with a negative potential concentrate the electric field at the point. This high electric field allows the electrons to "tunnel" through the tip into surrounding space which is normally maintained under high vacuum conditions. The magnitude of the potential required to produce sufficiently strong electric fields is proportional to the distance between the tip and the principal extraction electrode. This principal extraction electrode will be referred to as the extraction electrode. While this extraction electrode can be a physically separate structure, minimum extraction potentials can most conveniently be obtained by physically integrating the extraction electrode directly with the field emission cathode tips. This produces very small extraction electrode-cathode distances which are physically locked in proper alignment. Field emission cathode structures both with and with out integrated extraction electrodes are useful electron sources in a variety of current and potential applications such as displays, Vacuum Microelectronic Devices, and various electron microscopes.

The field emission display elements that utilize these cathodes use the basic field emission structure and add additional structures, such as, an extension of the vacuum space, a phosphor surface opposite the cathode tip, and additional electrodes to collect and/or control the electron current. Groups of individual Vacuum Microelectronic Devices and/or display elements are electrically interconnected during fabrication to form integrated circuits and/or displays.

While these filed emission cathode structures can be made in almost any size and may have applications as discrete sources, their best performance and major application is expected to come from extreme miniaturization, and dense arrays.

Non-thermionic field emitters, field emission devices, and field emission displays are all known in the art. The fabrication of the field emission cathode structure is a critical element common to the devices mentioned. The material (insulators and conductors/field emitters) are all deposited and processed by relatively common deposition and lithographic processing techniques with the single exception of a special sharp edge (blade) or point (tip) structure which is common to all field emission cathodes.

The art of fabricating the sharp field emission tip or blade can be broadly classified into five categories. Methods of creating the extraction electrode are also noted in the examples within these categories.

The first category is one of the earliest categories in which the cathode tip structure is formed by the direct deposition of the material. An example of this type is exemplified in a paper by C. A. Spindt, "A thin-Film Field-Emission Cathode", J. Appl. Phys., Vol. 39, No. 7, pages 3504–3505 (1968), in which sharp molybdenum cone-shaped emitters are formed inside holes in a molybdenum anode layer and on a molybdenum cathode layer. The two layers are separated by an insulating layer which has been etched away in the areas of the holes in the anode layer down to the cathode layer. The cones are formed by simultaneous normal and steep angle depositions of the molybdenum and alumina, respectfully, onto the rotating substrate containing the anode and cathode layers. The newly deposited alumina is selectively removed. Similar work has also been disclosed in U.S. Pat. No. 3,755,704.

A second category is the use of orientation-dependent etching of single crystal materials such as silicon. The principle of the orientation-dependent etching is to preferentially attack a particular crystallographic face of a material. By using single crystal materials patterned with a masking material, the anisotropically etched areas will be bounded by the slow etching faces which intersect at well defined edges and points of the material's basic crystallographic shape. A suitable combination of etch, material, and orientation can result in very sharply defined points that can be used as field emitters. U.S. Pat. No. 3,665,241 issued to Spindt, et al., is an example of this method in which an etch mask of one or more islands is placed over a single-crystal material which is then etched using an etchant which attacks some of the crystallographic planes of the material faster than the others creating etch profiles bounded by the slow etching planes (an orientation-dependent etch). As the slow etching planes converge under the center of the mask, multifaceted geometric forms with sharp edges and points are formed whose shape is determined by the etchant, orientation of the crystal, and shape of the mask. Orientation-dependent anisotropic etching while an established method to create the tips can also have an adverse effect by making these sharp tips blunt (or reducing the radius of the cathode tip), thus reducing their effectiveness as field emitters, as discussed by Cade, N. A. et al., "Wet Etching of Cusp Structures for Field-Emission Devices," IEEE Transactions on Electron Devices, Vol. 36, No. 11, pages 2709–2714 (November 1989).

A third category uses isotropic etches to form the structure. Isotropic etches etch uniformly in all directions. When masked, the mask edge becomes the center point of an arc which outlines the classic isotropic etch profile under the masking material. The radius of the arc is equal to the etch depth. Etching around an isolated masked island allows the etch profile to converge on the center of the mask leaving a sharp tip of the unetched material which can be used as a field emitter. An example of this is exemplified in U.S. Pat. No. 3,998,678, issued to Shigeo Fukase, et al. In this general class, an emitter material is masked using islands of a lithographically formed and etch resistant material. The emitter material is etched with an isotropic etchant which forms an isotropic etch profile (circular vertical profile with a radius extending under the resist from the edge). When the etch profile converges under the center of the mask from all sides, a sharp point or tip results. Extraction electrodes are sometimes added to the structure in subsequent operations.

A fourth category uses oxidation processes, which form a tip by oxidizing the emitter material. Oxidation profiles under oxidation masks are virtually identical to isotropic etch profiles under masks and form the same tip structure as the profiles converge under a circular mask. When the oxidized material removed the unoxidized tip can function as a field emitter. U.S. Pat. No. 3,970,887 issued to Smith et al. exemplifies this process. The process of this category is very similar to the isotropic etch category. A substrate of electron emission material such as silicon is used. A thermally grown oxide layer is grown on the substrate and is then lithographically featured and etched to result in one or more islands of silicon dioxide. The substrate is then reoxidized during which the islands of previously formed oxide act to significantly retard the oxidation of the silicon under them. The resulting oxidation profile is very similar to the isotropic etch profile and similarly converges under the islands leaving a sharp point profile in the silicon which can be exposed by removing the oxide. In this example, extraction electrodes are added to the structure after the tip has been formed. Other masking material such as silicon nitride can be used to similarly retard the oxidation and produce the desired sharp tip profile.

A fifth category etches a pit which is the inverse of the desired sharply pointed shape in an expendable material which is used as a mold for the emitter material and then removed by etching. U.S. Pat. No. 4,307,507 issued to Gray et al exemplifies a limited embodiment of this technique. Holes in a masking material are lithographically formed on a single crystal silicon substrate. The substrate is orientation-dependent etched through the mask holes forming etch pits with the inverse of the desired pointed shape. The mask is removed and a layer of emission material is deposited over the surface filling the pits. The silicon of the mold is then etched away freeing the pointed replicas of the pits whose sharp points can be used as field emitters. This patent does not disclose the use of an integrated extraction electrode.

All of the emitter formation techniques mentioned above have several limitations. Orientation-dependent etching requires the use of a substrate of single crystal emitter material. Most all of them require the substrate to be made of or coated with the emitter material. Most all of them form the emitter first which complicates the fabrication of the subsequent electrode layers.

Sometimes the methods used or the particular processing regime does not produce field emission tips of sufficiently small radius. The art includes some methods by which the tip can be sharpened to further reduce this radius. In a paper by Campisi et al, "Microfabrication Of Field Emission Devices For Vacuum integrated Circuits Using Orientation Dependent Etching", Mat. Res. Soc. Symp. Proc., Vol. 76, pages 67–72 (1987), reports the sharpening of silicon tips by slowly etching them in an isotropic etch. Another paper entitled "A Progress Report On The Livermore Miniature Vacuum Tube Project", by W. J. Orvis et al, IEDM 89, pages 529–531 (1989), reports the sharpening of silicon tips by thermally oxidizing them and then etching away the oxide. U.S. Pat. No. 3,921,022, also discloses a novel method of providing multiple tips or tiplets at the tip of a conical or pyramidical shaped field emitter.

It is now possible as exemplified in Busta, H. H. et al. "Field Emission from Tungsten-Clad Silicon Pyramids", IEEE Transactions on Electron Devices, Vol. 36, No. 11, pages 2679–2685 (November 1989), to use coating or cladding on these cathode tips or pyramids to enhance or modify the cathode tip properties.

In this developing field, the art has also started to show how these field emission cathodes and extraction electrodes can be used in a practical application, such as, in a display applications. U.S. Pat. No. 4,857,799 issued to Spindt et al illustrates how a substrate containing field emitters and extraction electrodes can be joined to a separate transparent window which contains anode conductors and phosphor strips, all of which can work in concert to form a color display. Another color display device using vacuum microelectronic type structure was patented in U.S. Pat. No. 3,855,499.

In summary a typical field emission cathode structure is made up of a sharply pointed tip or blade. The cathode tip or blade could also be surrounded by a control and/or extraction electrode. One of the key technologies in fabricating these devices is the formation of the sharp field emission (cathode) tip which has preferably a radius on the order of 10–100 nm. The most con, non methods of formation include orientation-dependent etching, isotropic etching, and thermal oxidation.

SUMMARY AND OBJECTS OF THE INVENTION

In one aspect the invention comprises of a process of making at least one field emission cathode structure comprising the steps of:

a) providing at least one hole in a substrate, b) depositing at least a first material and filling at least a portion of the hole sufficiently to form a cusp, c) depositing at least one layer of a material which is capable of emitting electrons under the influence of an electrical field, and filling at least a portion of the tip of the cusp, and d) removing the first material underneath the cusp to expose at least a portion of the tip of the electron-emitting material and thereby forming the at least one field emission cathode structure.

In another aspect the invention is a process of making at least one field emission cathode structure comprising the steps of:

a) forming at least one layer of an electrically conductive material over a base layer, b) forming at least one hole at least through the at least one electrically conductive layer, c) depositing at least an insulative material over the at least one electrically conductive layer and filling at least a portion of the hole sufficiently to form a cusp, d) depositing at least one layer of a material which is capable of emitting electrons under the influence of an electrical field, over the insulative material of step (c), and filling at least a portion of the tip of the cusp, and c) removing the material underneath the cusp to expose at least a portion of the electron-emitting material and thereby forming the at least one field emission cathode structure.

The invention is also a process of making at least one field emission cathode structure comprising the steps of:

a) forming a plurality of layers of electrically conductive material over a base layer, such that each of the layer of electrically conductive material is separated by an insulative material, b) forming at least one hole at least through the electrically conductive layers, c) depositing at least an insulative material over the layers of electrically conductive material and filling at least a portion of the hole sufficiently to form a cusp, d) depositing at least one layer of a material which is capable of emitting electrons under the influence of an electrical field, over the insulative material of step (c), and filling at least a portion of the tip of the cusp, and e) removing the material underneath the cusp to expose at least a portion of the electron-emitting material and thereby forming the at least one field emission cathode structure.

Still another aspect of this invention comprises a field emission cathode structure comprising a layer of material which is capable of emitting electrons under the influence of an electrical field, and having at least one tip formed by the process of this invention for the emission of electrons.

The field emission cathode structure of this invention further comprises on the tip side of the electron-emitting layer at least one electrically conductive material which is separated from the layer by at least one insulative material such that the emitter tip is exposed.

The field emission cathode structure of this invention still further comprises on the tip side of the electron-emitting layer a plurality of electrically conductive material, each of which is separated from each other and the electron-emitting layer by at least one insulative material such that the emitter tip is exposed.

The field emission cathode structure of this invention could further comprise on the tip side of the electron-emitting layer at least one barrier layer, which is selectively removed to expose the tip.

A product can also be made by any of the process of this invention.

It is an object of this invention to form individual or arrays of field emission tips.

Another object of this invention is to eliminate the dependence on single crystal materials while maintaining a high degree of flexibility in the choice of field emission materials.

Another object is to fabricate an integrated extraction electrode which is both self-aligned and formed as part of the tip formation process rather than added as a subsequent operation thus greatly simplifying the total fabrication process.

It is also an objective to use common microminiature integrated circuit fabrication techniques to create these structures.

Yet another objective is to provide a means of isolating and interconnecting multiple field emitters, extraction electrodes, and other electrodes in useful electrical configurations.

The objects of the present invention are achieved by using the cusp that is formed when a hole in an substrate is filled using a conformal layer deposition or formation technique. The cusp serves as a mold that can be filled with any material that is capable of emitting electrons under the influence of an electric field (emitter layer). Once the mold is removed either by some common release mechanism or by selectively etching both the substrate and the cusp forming layer, a sharp tip which is the replica of the cusp is freed.

This tip is expected to have a small enough radius as formed to act as a field emission cathode. If for any reason a sharper tip is desired, tips may sharpened using procedures already known in the art, such as slow isotropic tip etching, or the oxidation and subsequent removal of the oxide.

The process is not limited to any particular material. Many materials and material combinations can be used for substrate, conformal layer, and emitter material.

An extraction electrode can be added to the basic structure by first depositing a conductive electrode layer on the base substrate. The hole that is to be later used to form the cusp is etched through the conductive electrode layer and to or into the substrate. The conformal cusp forming layer is deposited or formed followed by the deposition of the emitter layer. The substrate is released or etched away selectively with an etchant that does not attack the conductive electrode. The conformal layer is then removed selectively by an etchant that toes not attack either the conductive electrode (extraction electrode) or the emitter material, until the tip is freed to the desired degree.

When this structure is placed, for example, in a vacuum and a sufficiently high potential is placed across the extraction electrode which is positive, ana the field emission tip which is negative, the resulting high electric field on the tip allows electrons to tunnel out of the tip into the vacuum space.

The process further allows the addition of more electrodes which can be used for extraction, control, or the selection of particular emitter structures within an array of such structures. These additional electrodes are added starting with the electrode covered substrate. A layer of an insulator is deposited followed by the deposition of an additional electrode layer. Each repetitive deposition of this new pair of layers will create an additional electrode. The hole that will be later used to form the cusp is now etched through all of the electrode and insulator layers down to or into the base layer itself. The process then proceeds just as it would be performed for the single extraction electrode structure.

Multi-electrode structures open the possibility of nonproductive undercut etching of the insulators between electrodes. This occurs if isotropic etches which attack both the conformal cusp forming material and the electrode insulators is used. This can be minimized or eliminated by using an anisotropic etch which does not significantly attack the material of the first electrode, which is nearest the substrate, or the emitter layer.

Release or barrier layers can be used at various steps in the process to provide for easy release of molds or substrates from the complete or partially complete structure, or as etch stops, or as protective layers to aid in controlling the process. As an example, if one wants to make a silicon emitter tip using a cusp formed in conformally deposited silicon, the silicon-silicon interface would not allow the selective removal of the cusp to free the tip. This impediment can be eliminated by the addition of a very thin film of silicon nitride onto the cusp layer, followed by the silicon deposition to fill the cusp. This additional layer will now allow the cusp silicon etch to be stopped by the silicon nitride. The nitride can subsequently be removed with an etchant such as boiling phosphoric acid that does not attack the remaining silicon thus freeing the tip.

The electrode layers including the emitter layer are typically good conductors and as such they can be lithographically patterned before the next layer is added to form isolations and interconnections between emitter structures. Similarly the associated insulators can be lithographically featured to provide via openings for vertical interconnections. One use of such patterning is the formation of X and Y addressing lines which can be used to selectively activate individual or groups of emitters for display applications.

Additional advantages and features will become apparent as the subject invention becomes better understood by reference to the following detailed description when considered in conjunction with the accompanying drawings.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

Figure 1A:
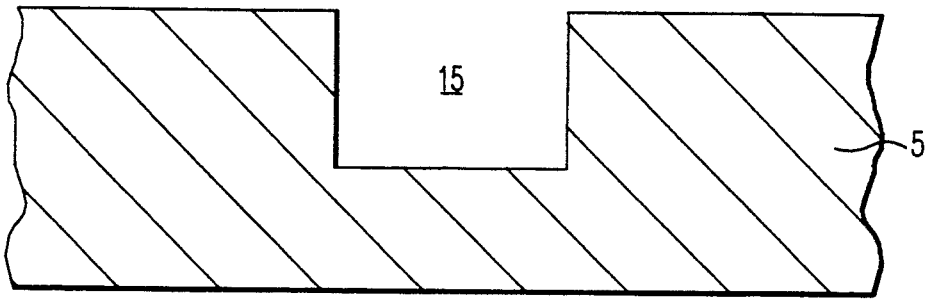
FIG. 1A, is a cross-sectional view of a single layered substrate having at least one hole for the subsequent formation of the emitter tip.

This invention describes a novel new technique and structure for the integrated fabrication of both field emission cathodes, and field emission cathodes with integral single or multiple extraction and/or control electrodes. Both of these structures may be made as individuals or groups.

The detailed description of these field emission cathode structures and the processes for fabricating them have been simplified by using several predefined and named process sequences or definitions that are repetitively referenced.

The field emission cathode of this invention may be used as an electron source in a Vacuum Microelectronic Device. The term VMD or Vacuum Microelectronic Device as used herein, means not only a diode but a triode, tetrode, pentode or any other device that is made using this process, including the interconnection thereof. Basically, a VMD is any device with at least a sharp emitter (cathode) tip, and a collector (anode) with an insulator separating the emitter from the anode and there is preferably a straight-line or direct transmission of electrons from the emitter to the collector (anode).

The term "lithographically defined" refers to a process sequence of the following process steps. First a masking layer that is sensitive in a positive or negative sense to some form of actinic radiation, for example, light, e-beams, and/or X-rays, is deposited on the surface of interest. Second, this layer is exposed patternwise to the appropriate actinic radiation and developed to selectively remove the masking layer and expose the underlying surface in the patterns required. Third the exposed surface is etched to remove all or part of the underlying material as required. Fourth, the remaining areas of the masking layer are removed.

Alternatively, the term 37 lithographically defined" can refer to following "liftoff process." The same required patterns in a material layer as produced in the previously described process are created. This process starts on the surface that is to receive the desired patterned material layer. First, a masking layer that is sensitive in a positive or negative sense to some actinic radiation, for example, light, e-beams, and/or X-rays, is deposited on the surface. Secondly, this layer is exposed patternwise to the appropriate actinic radiation and developed to selectively remove the masking layer and expose the underlying surface in patterns where the desired material layer is to remain. The deposition, exposure, and development process is controlled in such a way that the edges of the remaining mask image has a negative or undercut profile. Thirdly, the desired material is deposited over both the open and mask covered areas by a line of sight deposition process such as evaporation. Finally, the mask material is removed, for example, by dissolution and freeing any material over it and allowing it to be washed away.

The term "conductive material" or "conductor layer" or "conductive substrate" refers to any of a wide variety of materials which are electrical conductors. Typical examples include the elements Mo, W, Ta, Re, Pt, Au, Ag, Al, Cu, Nb, Ni, Cr, Ti, Zr, and Hf, alloys or solid solutions containing two or more of these elements, doped and undoped semiconductors such as Si, Ge, or those commonly known as III-V compounds, and non-semiconducting compounds such as various nitrides, borides, cubides (for example $LAB_6$), and some oxides (of for example Sn, Ag, InSn).

The term "insulative material" or "insulator layer" or "insulative substrate" refers to a wide variety of materials that are electrical insulators especially glasses, and ceramics. Typical examples include elements such as carbon in a diamond form (crystalline or amorphous), single crystal compounds such as sapphire, glasses and polycrystalline or amorphous compounds such as some oxides of Si, Al, Mg, and Ce, some fluorides of Ca, and Mg, some carbides and nitrides of silicon, and ceramics such as alumina or glass ceramic.

The term "electron-emitting material" or "emitter layer" or "emitter material" refers to any material capable of emitting electrons under the influence of an electric field. Typical examples include and of the electrical conductors, such as in the examples listed above, and borides of the rare earth elements, solid solutions consisting of 1) a boride of a rare earth or an alkaline earth (such as Ca, St, or Ba), and 2) a boride of a transition metal (such as Hf or Zr). The emitter material can be a single layered, a composite or a multilayered structure. As an example, a multilayered emitter might include the addition of one or more of the following; a work function enhancement layer, a robust emitter layer, a high performance electrically conductive layer, a thermally conductive layer, a physically strengthening layer or a stiffening layer. This multilayered composite may contain both emitter and non-emitter materials, which can all act synergistically together to optimize emitter performance. An example of this is discussed in Busta, H. H. et al. "Field Emission from Tungsten-Clad Silicon Pyramids", IEEE Transactions on Electron Devices, Vol. 36, No. 11, pages 2679–2685 (November 1989), where they show the use of coating or cladding on these cathode tips or pyramids to enhance or modify the cathode properties.

This coating or cladding can also be used in situations where one cannot form the desired tip structure or it is difficult to form the desired tip structure for the cathode emitter.

The term "deposited" refers to any method of layer formation that is suitable to the material as are generally practiced throughout the semiconductor industry. One or more of the following examples of deposition techniques can be used with the previously mentioned materials, such as, sputtering, chemical vapor deposition, electro or electroless plating, oxidation, evaporation, sublimation, plasma deposition, anodization, anodic deposition, molecular beam deposition or photodeposition.

The term "tip" as used herein means not only a pointed projection but also a blade. Field emitter shapes other than points are sometimes used, such as blades. Blades are formed using the same methods except that the hole is a narrow elongated segment. The shape of the sharp edge of the blade can be linear or circular or a linear segment or a curve segment to name a few.

The hole to make the field emission cathode structure of this invention is preferably formed by a process selected from a group comprising, ablation, drilling, etching, ion milling or molding. The hole can also be etched, using etching techniques selected from a group comprising anisotropic etching, ion beam etching, isotropic etching, reactive ion etching, plasma etching or wet etching. The hole profile or dimensions could be constant with depth or vary with depth.

After the emitter tip has been formed, the material underneath the tip in the cusp forming layer or material, is removed preferably by a process selected from the group comprising, dissolution, etching, evaporation, melting or subliming. As discussed elsewhere the entire substrate underneath the layer of electron-emitting material could also be completely removed. In some situations the entire material underneath the electron-emitting material can be completely removed.

A barrier layer or material could also be formed prior to the deposition of the electron-emitting material. The barrier layer subsequently can be selectively removed.

The field emission cathode structure of this invention can be used as an electron source. As discussed elsewhere at least one tip of this cathode structure could be electrically isolated from another tip, or at least one tip could be electrically connected to another electronic component. Of course the field emission cathode structure of this invention could be used in or be a part of an electronic display device.

The following fabrication sequences and the related diagrams illustrate the formation of individual structures. While not specifically shown, multiple structures in any spatial pattern can be simultaneously fabricated.

Figure 1B:
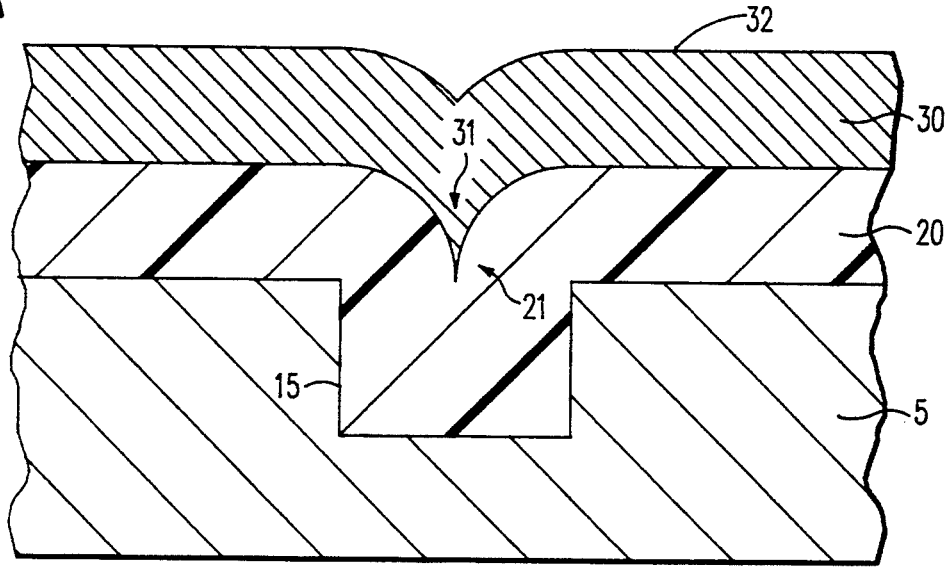
FIG. 1B, is a cross-sectional view showing the deposition of a cusp forming layer and an emitter layer over the substrate.
Figure 1C:
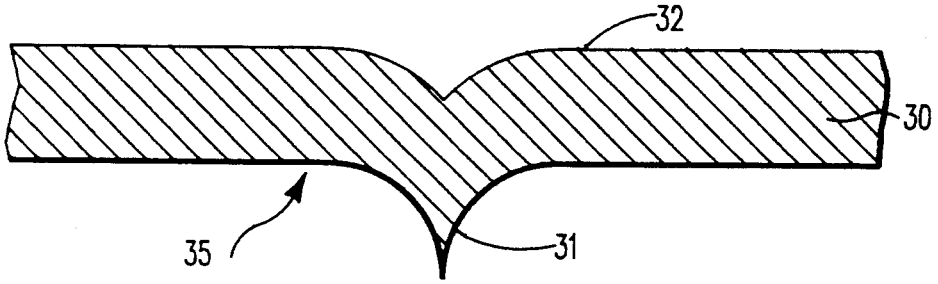
FIG. 1C, shows a cross-sectional view of a free standing emitter layer after the emitter tip has been freed.

FIGS. 1A through 1C, demonstrate the fabrication of the simplest field emission structure 35, having the field emission tip 31, on a field emission layer 30. Starting with expendable substrate or base layer 5, which can be of any material suitable to subsequent processing, a hole or recess or opening 15, is formed, as for example by lithographical techniques. The substrate or base 5, could be a single-layered or a multilayered structure. The shape of the hole 15, can be square, round, oval, etc., and the hole 15, can be formed by any method known to a person skilled in the art, for example, hole 15, can be etched by reactive ion etching (RIE) which typically results in the profile shown in FIG. 1A. To obtain the optimum results the depth of the hole 15, should be greater than half of its diameter. Therefore, the base or substrate 5, should be of sufficient thickness to allow for the proper formation of hole 15. The effects of hole profile variations will be discussed later.

A layer of a second expendable material 20, is conformally deposited on the substrate 5, until the growing thickness on the sidewalls of the hole 15, converge in the center of hole 15, to form a cusp 21. An emitter layer 30, is deposited to fill cusp 21, as well as other desired areas as shown in FIG. 1B.

Substrate 5, is now selectively etched away. The top of emitter layer 30, or the surface 32, away from the emitter tip 31, may be protected if necessary by mechanical means or by the temporary deposition of a masking or backing layer which is subsequently removed. Layer 20 is then selectively removed freeing tip 31, as shown in FIG. 1C.

Alternatively, if the adhesion between layers 30, and 20, is small, or if it is intentionally made small through the use of release agents or a thin release layer between layers 20 and 30, layer 30 can be pealed off from the layer 20, avoiding the need to etch substrate 5 and layer 20, which will again result in the structure shown in FIG. 1C. The release agent or the thin release layer that is used between layers 20 and 30, will depend upon the material that is used to make layers 20 and 30.

Figure 1D:
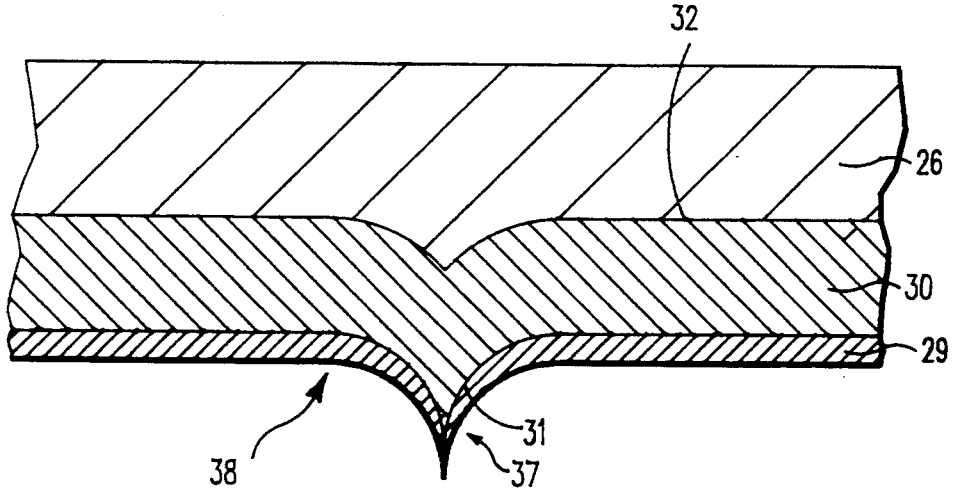
FIG. 1D, shows a cross-sectional view of a free standing emitter layer after the emitter tip has been cladded and the emitter layer has been provided with a support layer.

The field emission cathode 35, can also be coated or clad with a layer 29, as illustrated in FIG. 1D, and would result in a coated or clad field emission cathode 38. The layer 29, must be of a material which is capable of emitting electrons under the influence of an electrical field. Therefore, it is obvious that if the "emitter tip" can be coated or clad with an electron-emitting material then the emitter layer 30, could be made from any material that will subsequently allow the cladding or coating of the "emitter tip" with an electron-emitting material 29. The emitter tip 37, will result from coating or cladding "emitter tip" 31, with layer 29. As shown in FIG. 1D, on the back 32, of emitter layer 30, one could also provide a backing or support layer 26. The multilayered structure, as shown in FIG. 1D, illustrates an example where at least a portion of the different layers are coextensive.

Figure 2A:
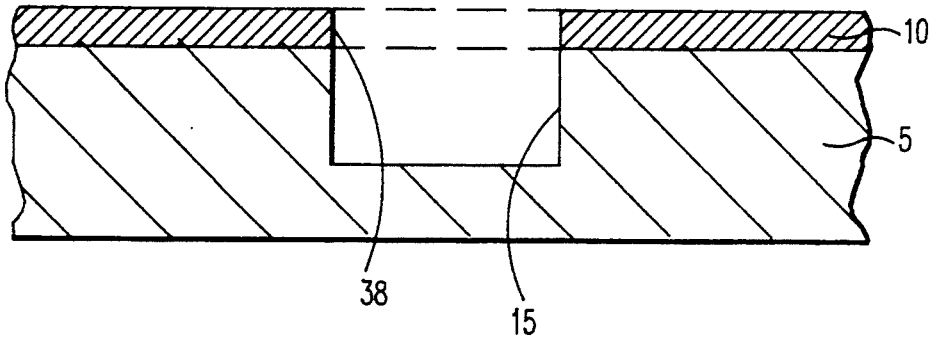
FIG. 2A, is a cross-sectional view of another embodiment of the invention showing a substrate comprising of one expendable layer under an electrode layer and having at least one hole.

The basic process can be expanded, as shown in FIGS. 2A through 2D, to create cathode 40, by forming an emitter tip 41, which is self-aligned inside an integral extraction electrode 10. To fabricate the electrode 40, electrode layer 10, is deposited on an expendable base layer or substrate 5. Hole 15, having a mouth or opening 38, is lithographically featured typically using RIE through electrode layer 10, into the substrate 5, to a depth which is greater than half the diameter of the hole 15, as shown in FIG. 2A. Of course the substrate 5, should be thick enough to allow for the proper formation of hole 15.

Figure 2B:
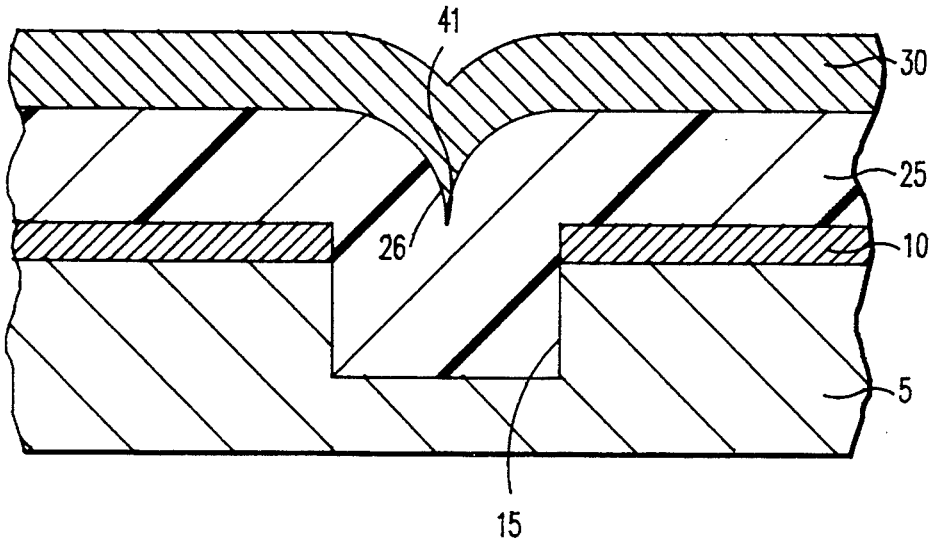
FIG. 2B, is a cross-sectional view showing the structure of FIG. 2A, covered with a cusp forming layer and the emitter material layer.

An insulator layer 25, is conformally deposited on the electrode layer 10, and fills the hole 15, in the base layer or substrate 5, to form the cusp 26. Emitter layer 30, is then deposited to fill cusp 26, as shown in FIG. 2B.

Figure 2C:
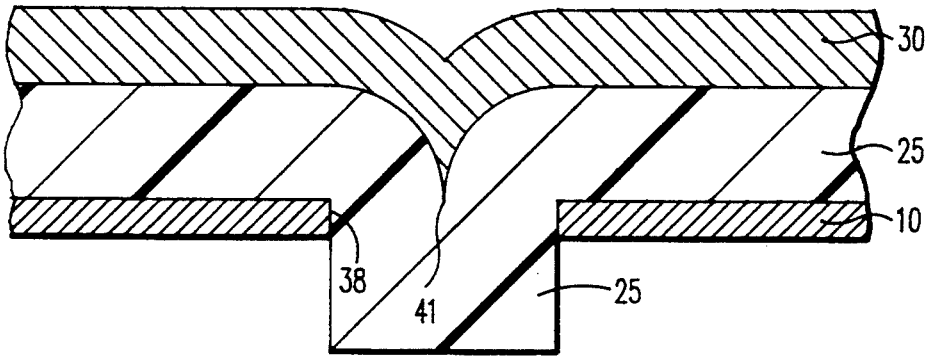
FIG. 2C, is a cross-sectional view showing the structure of FIG. 2B, after the expendable layer has been removed.

The expendable base layer or substrate 5, is selectively etched away leaving behind the structure as shown in FIG. 2C.

Figure 2D:
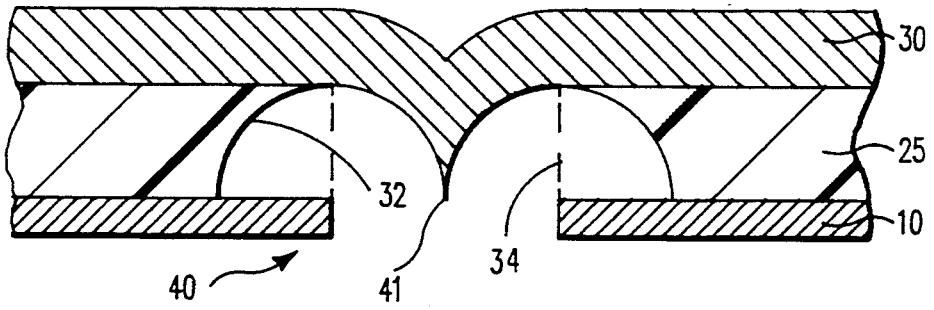
FIG. 2D, is a cross-sectional view of the emitter tip being exposed after the partial removal of the cusp forming layer within an integrated extraction electrode.

Insulator 25, is then selectively etched through the mouth or opening 38, in electrode 10. FIG. 2D, shows the resulting cathode structure 40, having a cathode tip 41, that is self-aligned inside an integral extraction electrode 10. The etch profile for an isotropic etch 32, is shown in FIG. 2D, while phantom lines 34, depict an etch profile that would result if a selective anisotropic etch was used instead to etch insulator layer 25.

Figure 3A:
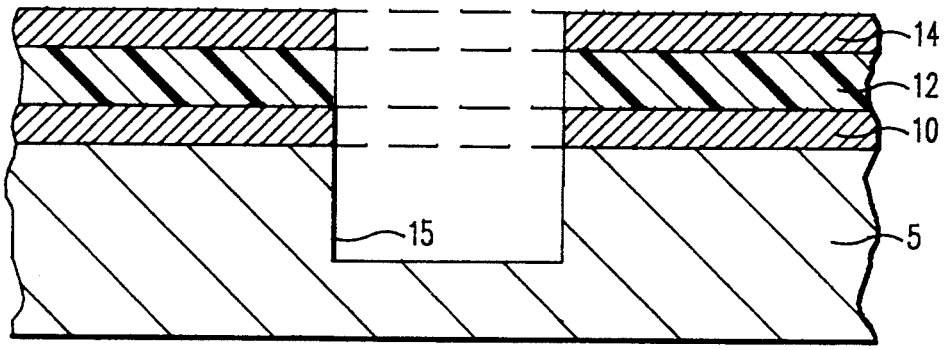
FIG. 3A, shows a cross-sectional view of still another embodiment of the invention showing a substrate comprising two electrode layers separated by an insulator layer over a base layer, and having at least one hole.
Figure 3B:
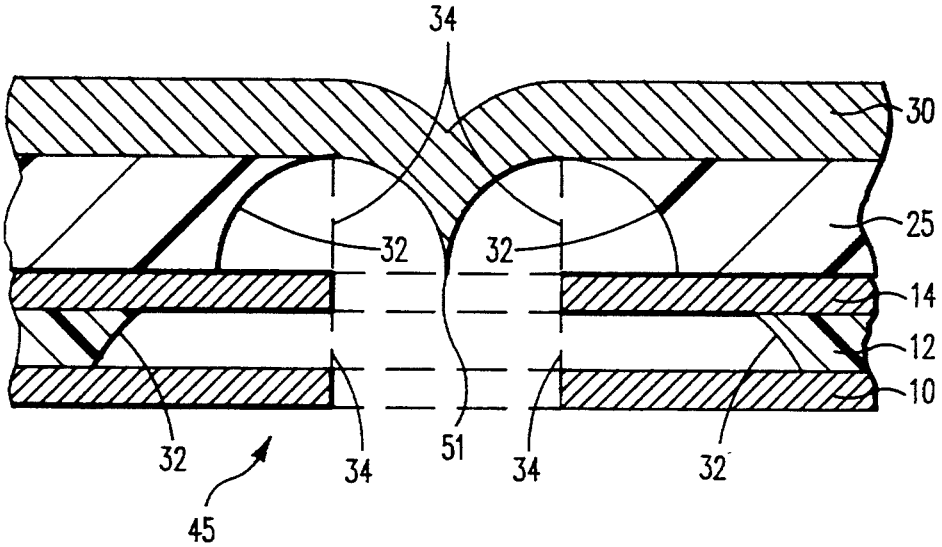
FIG. 3B, is a cross-sectional view showing the structure of FIG. 3A, after the emitter tip has been exposed.

A further expansion of the basic process, as shown in FIGS. 3A, 3B and 3C, allows the formation of an emitter tip that is self-aligned in several electrodes which can be used for extraction and control of the electron current. The structure 45, illustrates a cathode with two extraction/control electrodes. As shown in FIG. 3A, the structure can be made starting again by depositing electrode layer 10, on expendable substrate 5, depositing insulator layer 12, on the already deposited electrode layer 10, and then depositing electrode layer 14, on the insulator layer 12. The hole or opening 15, is lithographically formed etching through layers 14, 12 and 10, to or into expendable substrate 5.

The process then proceeds as before, by conformally depositing insulator 25, to form a cusp (not shown), depositing emitter layer 30, to fill the cusp, removing the expendable substrate 5, by peeling or etching, and then selectively etching insulator 25, from the bottom to expose emitter tip 51, as shown in FIG. 3B. The degree of exposure can be varied as desired, by altering the etch time. FIG. 3B, shows the etch profiles 32, that results from etching layer 25, that had filled the hole 15, with an isotropic etch. A portion of the insulator layer 12, also gets etched when an isotropic etch is used. The evident undercut serves no useful purpose and may actually be detrimental by weakening the structure and occupying more spatial area then needed. This undercut can be eliminated by using an anisotropic etch such as RIE. The phantom lines 34, depict the etch profile that would result if an anisotropic etch had instead been used to etch layer 25.

RIE etches are favored for their anisotropy and all dry processing but they are often not totally selective but rely on significant differences in the etch rates between different materials. Depending on the materials some desirable RIE processes, such as that suggested in the fabrication of structure 45, (FIG. 3B) to remove insulator 25, and expose emitter tip 51, without undercut, may actually attack the emitter material very slowly but enough to undesirably reduce the radius of tip 51. One method of correcting such a problem, if it occurs, is to sharpen the tip as as been described elsewhere.

Figure 4A:
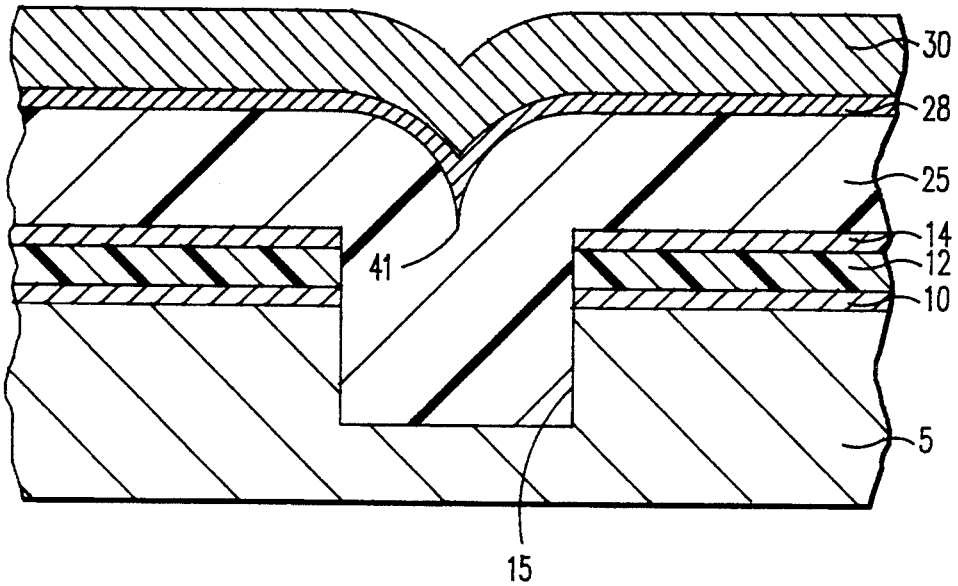
FIG. 4A, is a cross-sectional view showing yet another embodiment of this invention where the emitter layer has a barrier layer along with multiple electrodes separated by insulating material.
Figure 4B:
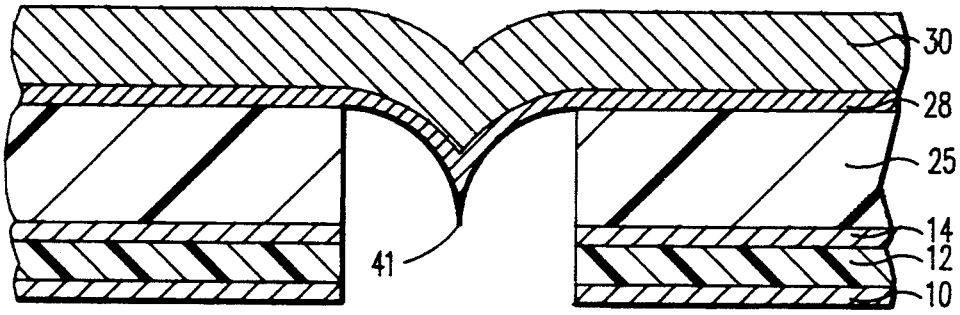
FIG. 4B, shows a cross-sectional view of the structure of FIG. 4A, where the barrier material at and around the emitter tip has been exposed.
Figure 4C:
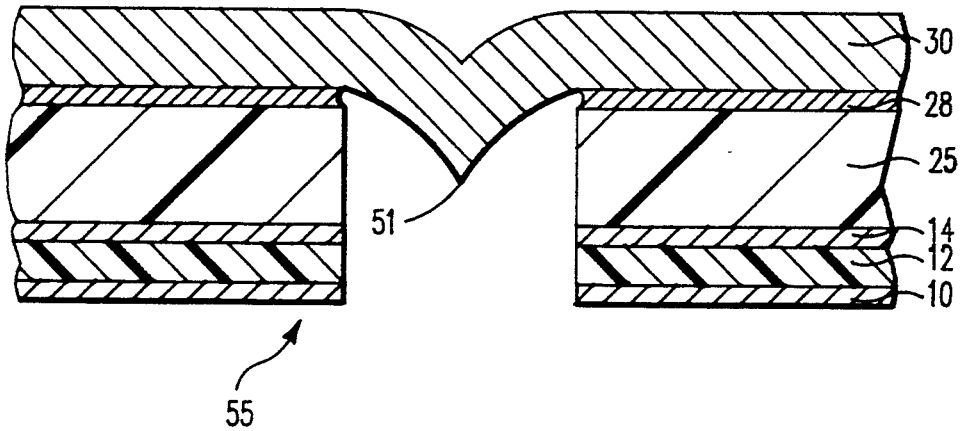
FIG. 4C, shows a cross-sectional view of the structure of FIG. 4B, where the barrier material at and around the emitter tip has been removed and the emitter tip has been exposed.

Alternatively, FIGS. 4A through 4C, show how such damage can be avoided and also represent an example how barrier layers can be used. The two electrode (plus emitter) field emission cathode of structure 45, is used for illustration. All of the steps up to the formation of the cusp are identical to those of the preceding paragraphs. After the formation of the cusp, a very thin barrier layer 28, which preserves the cusp profile is deposited to cover layer 25. The barrier can be any material that forms a film, that preserves the cusp structure, that is selectively removable without damage to the other cathode substructures, and is stable enough to remain with the finished structure. An example of such a material that could be used with doped silicon electrodes, doped silicon emitter, and silicon dioxide insulators, is silicon nitride which is selectively soluble in hot phosphoric acid. The emitter layer 30, is deposited over the barrier layer 28, to fill the cusp as shown in FIG. 4A.

The substrate 5, is then removed by peeling or etching. The insulator layer 25, is then etched using the RIE process to expose barrier 28, without undercutting electrodes 10 or 14, as shown in FIG. 4B.

The barrier layer 28, can now be selectively etched exposing emitter tip 51, and completing the structure 55, as shown in FIG. 4C.

All of the previous examples have illustrated hole 15, with the more or less vertical wall profile of a classical anisotropic etch. While this profile will result in functional structures, there are many variations of this profile that will also create functional structures and that have other useful attributes as well.

Figure 5A:
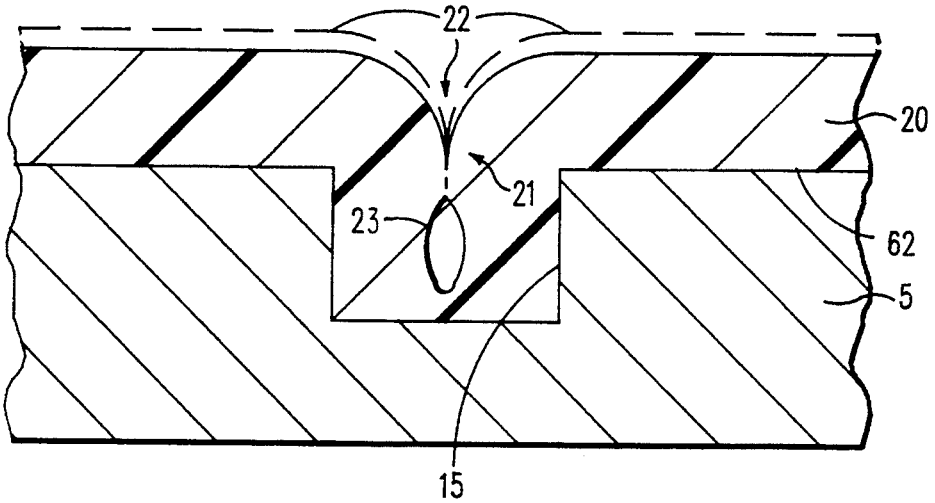
FIG. 5A, is a cross-sectional view showing a cusp that results from conformally filling a hole whose dimensions do not change with depth.
Figure 5B:
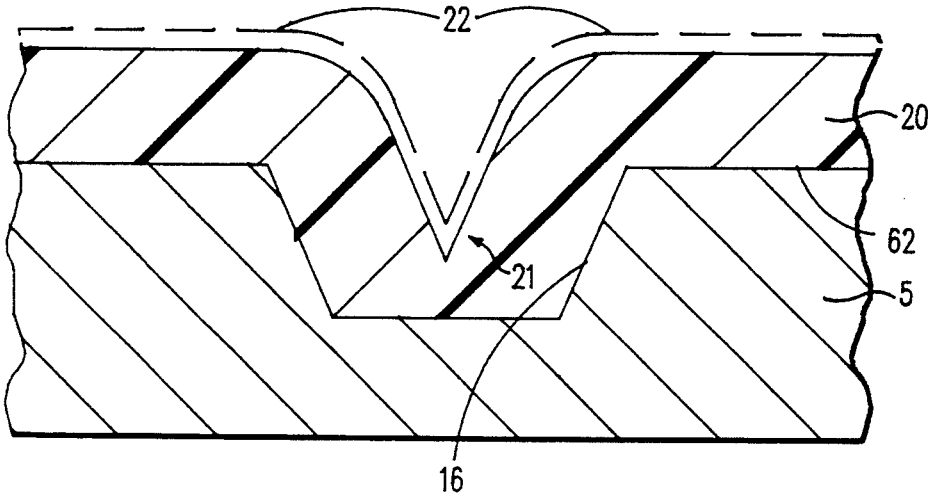
FIG. 5B, shows a cross-sectional view of another method of making a cusp from an opening having a different profile so that the location of the cusp could be adjusted.
Figure 5C:
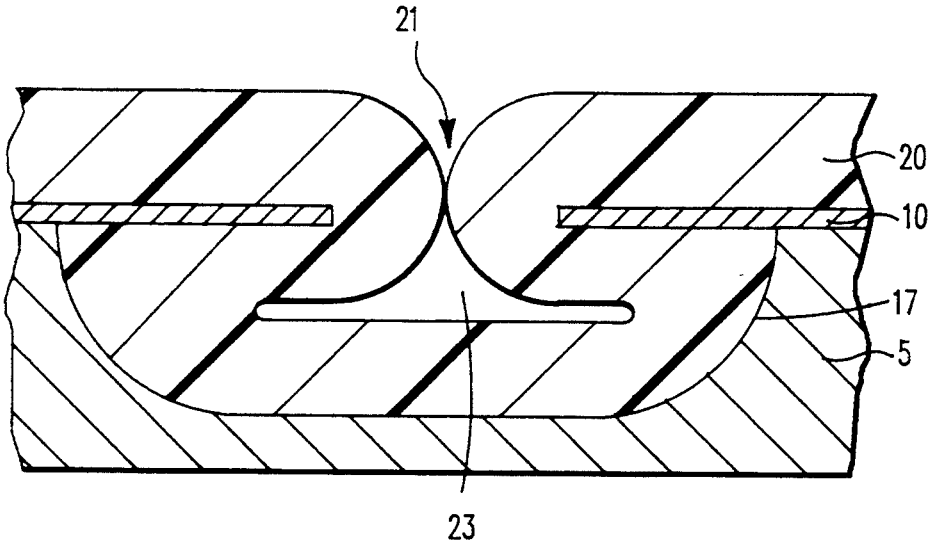
FIG. 5C, shows a cross-sectional view of still another method of making a cusp from an opening having still a different profile.

FIG. 5A, illustrates a typical cusp forming hole profile, while FIGS. 5B and 5C, illustrate some of the alternative cusp forming hole profiles. Holes 15, 16 and 17, are shown as being in simple solid substrates, but they are not limited in any way to these examples and may be usefully created in the previously discussed multielectrode or multilayered substrate or composites as well.

FIG. 5A, shows the vertical sidewall hole 15, which has been used in the previous descriptions of the process. It has the advantage of occupying the smallest spatial area. One of its characteristics is that the tip 21, of the cusp initially forms at the level of the substrate surface 62, and if the conformal deposition is continued will move vertically upwards as shown by phantom line 22, to a position above the surface whose height is controlled by the amount of additional deposition. Under some deposition conditions one or more voids 23, may form in the hole 15. Since the material 20, in the hole 15, will be removed later to free the emitter tip (not shown), these voids are not detrimental to the invention.

In many applications such as field emission cathode 35, as shown in FIG. 1C, the location of the emitter tip 31, may be of little or no consequence, but in applications using additional electrodes, a more optimum placement of the emitter tip is desired. Some field models suggest that the optimum placement of the emitter tip is at a height between the heights of the top and bottom of the electrode layer nearest to the emitter layer.

One method of adjusting this placement is to adjust the profile of the vacuum space hole. An example of such a profile is shown in FIG. 5B, where the dimensions of the hole profile varies or changes with depth. Hole 16, has sloped sidewalls so that the conformal film 20, grows perpendicular to the sloped side wall which forces initial convergence at a point equidistant from the sides and bottom which is well below the top surface 62, of the substrate 5. Additional deposition as shown by phantom lines 22, moves the cusp upward and the location of the cusp can be selected to nominally place the cusp vertically where desired. This allows a process variations to move the cusp up or down through desired range. With proper choice of the nominal position and the vacuum space hole wall angle, the accumulated process tolerances can be absorbed and the cusp will stay within its optimal placement range.

FIG. 5C, shows that complex hole profiles can be used to produce useful cusp structures. In this example electrode layer 10, on substrate 5, was lithographically featured with hole 17, first by anisotropically etching into electrode 10, followed by the selective isotropic etching of the substrate 5. The deposition of conformal layer 20, produces the cusp 21, and may produce void 23. It should be noted that void 23, does not affect the successful use of this structure for the formation of the emitter tip (not shown) because it will be subsequently removed to expose the emitter tip.

Figure 6:
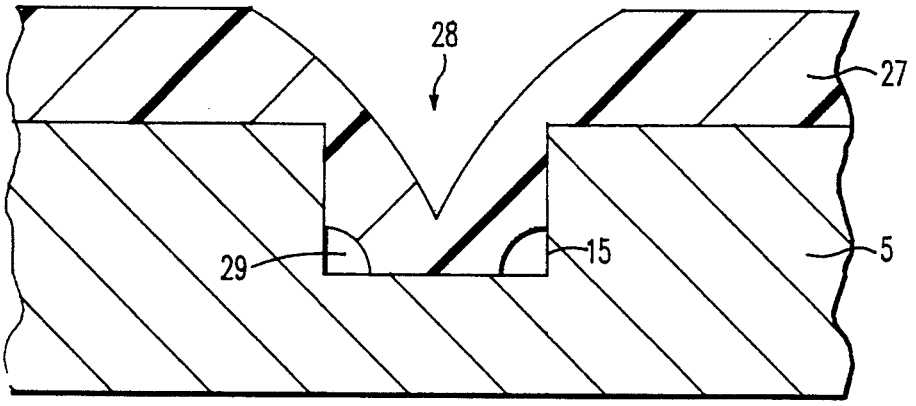
FIG. 6, shows a cross-sectional view of a cusp made by a marginally conformal process in a hole whose dimensions are constant with depth.

FIG. 6, is an example of how even marginally conformal processes can be used to form useful cusp structures. In this example, nominally vertical walled hole 15, in substrate 5, is sputter coated with layer 27. The cusps produced should have the following attributes. First, it should be open and should thus be easier to fill. Secondly, it should naturally form below the surface of the electrode without requiring special vacuum space hole profiles.

Even though sputter deposition is only a partially conformal deposition technique, materials like sputtered quartz are good and very stable insulators, and thus will produce useful cusp structures 28. One traditional problem with sputtering is its tendency to leave voids or "mouse holes" 29, at the bottom edge of the hole 15. While these are potentially very harmful to semiconductor personalization processes, for the purposes of this invention, they are not detrimental because layer 27, will later be removed from this area after the emitter tip (not shown) is formed.

Figure 7A:
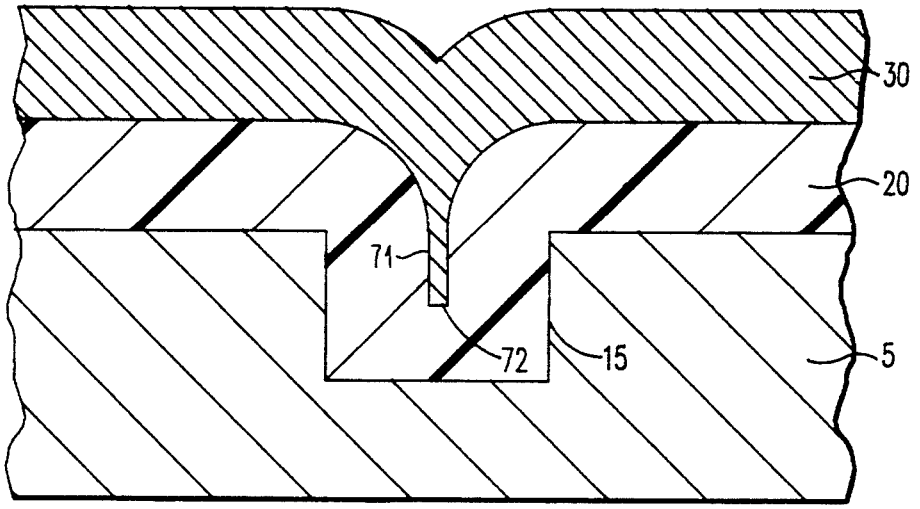
FIGS. 7A, 7B and 7C, illustrate a cross-sectional view of a field emission cathode that had a blunt tip that was sharpened.
Figure 7B:
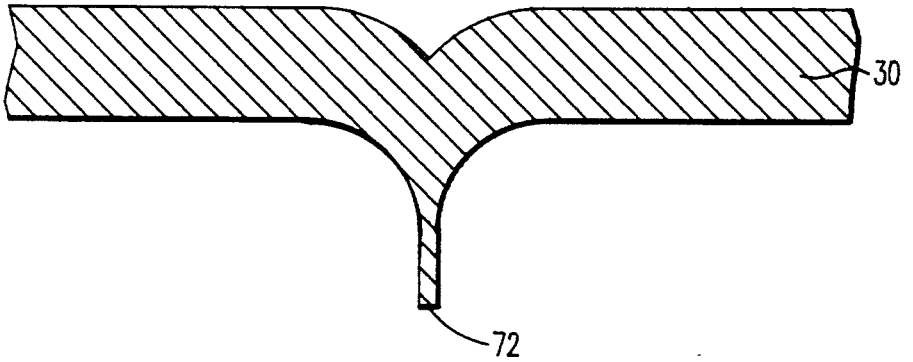
Figure 7C:
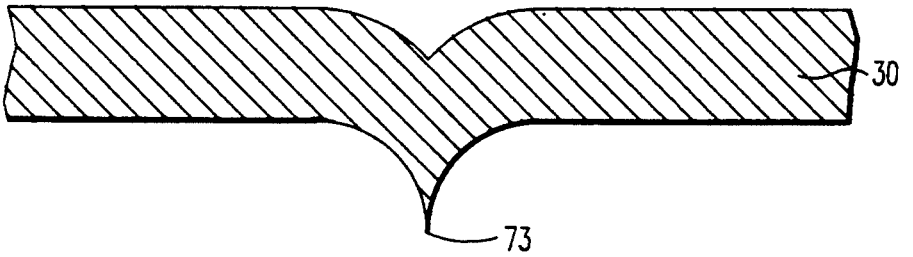

The sharply pointed cusp is the ideal shape for molding the field emitters but incompletely formed molds can also be used. FIG. 7A, shows the shade of the conformal film recess 71, that forms before the sidewalls converge to form the cusp. While this recess 71, is not sharply pointed, it can still be used to mold emitter materials deposited into it. After the substrate 5, and cusp forming layer or film 20, is removed, as described in previous sections, the emitter material 30, has the approximate shape of a tip 72, which is more like a blunt tip, as shown in FIG. 7B. This approximate shape can be sharpened using the sharpening techniques previously mentioned in the "Background of the Invention" section to create the desired sharply pointed emitter 73, as shown in FIG. 7C.

Means of isolating and interconnecting multiple field emitters, extraction electrodes, and other electrodes in useful electrical configurations can also be provided. This can be done because, the electrode layers including the emitter layer are typically good conductors and as such they can be lithographically patterned before the next layer is added to form isolations and interconnections between emitter structures. Similarly the associated insulators can be lithographically featured to provide via openings for vertical interconnections. One use of such patterning is the formation of X and Y addressing lines which can be used to selectively activate individual or groups of emitters for display applications. Groups of individual Vacuum Microelectronic Devices and/or display elements are electrically interconnected during fabrication to form integrated circuits and/or displays.

Figure 8:
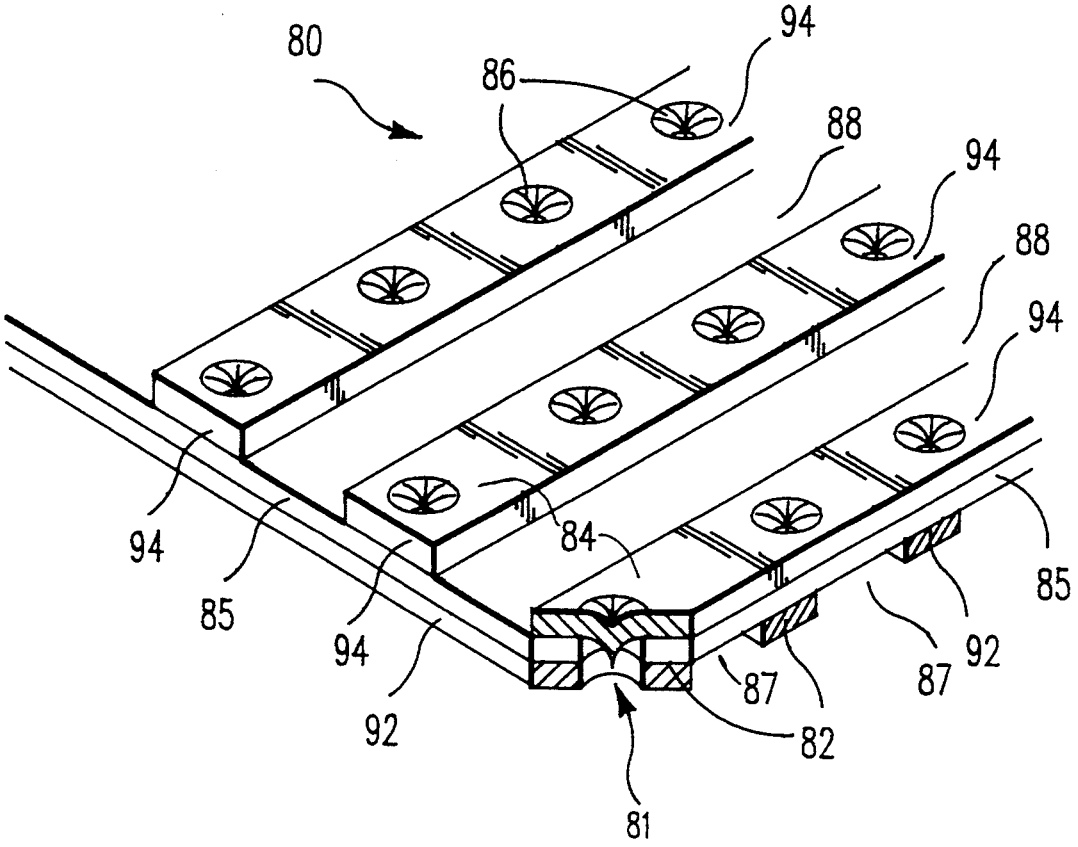
FIG. 8 illustrates a perspective and a partial cut-away view of a field emission cathode that has been interconnected.

An example of an interconnection of the field emission cathodes is shown in FIG. 8. In the field emitter interconnect 80, the emitter layer has been lithographically featured into lines which interconnect individual emitters 84, in the "X" direction and form "X" emitter lines 94. The space 88, isolates one "X" emitter line 94, from another "X" emitter line 94. Similarly, the extraction electrode layer is lithographically featured into "Y" electrode line 92, with spaces 87, that isolate one "Y" electrode line 92, from another "Y" electrode line 92. Instead of open spaces 87 and 88, one could also have insulating material there. Insulating or cusp forming layer 85, separates the individual extraction electrode 82 or "Y" electrode line 92, from the individual emitter electrode 84 or the "X" emitter line 94. Also, shown is the secondary cusp 86, that will result from the formation of the emitter tip 81. Of course it would be obvious to one skilled in the art to have one or more electrodes in this structure between the emitter electrode and the anode (not shown). This interconnection arrangement allows a particular emitter to be activated by putting a negative potential on a particular emitter 84, in the "X" emitter line 94, and a positive potential on a particular extraction electrode 82 or "Y" electrode line 92.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A field emission cathode structure comprising at least one layer of material which is capable of emitting electrons under the influence of an electric field, and having at least one tip for the emission of electrons formed by the process comprising the steps of:

(a) providing at least one hole in a substrate, (b) depositing at least a first material and filling at least a portion of said hole sufficiently to form a cusp, (c) depositing said at least one layer of a material which is capable of emitting electrons under the influence of an electrical field, and filling at least a portion of said cusp to form said at least one electron emitting layer, wherein said electron emitting layer has an upper surface and a lower surface, said upper surface having at least one secondary cusp, said lower surface having at least one tip, such that at least one tip is opposite said at least one secondary cusp, and wherein at least a portion of the surface of said tip is concave and wherein said at least one tip is used for the emission of said electrons, and (d) removing at least a portion of said substrate and at least a portion of said first material to expose at least a portion of said tip of said electron-emitting material and thereby forming said at least one field emission cathode structure.

2. The field emission cathode structure of claim 1, wherein said electron-emitting layer is a multilayered structure.

3. The field emission cathode structure of claim 1, wherein at least one tip of said electron-emitting layer is a multilayered structure.

4. The field emission cathode structure of claim 1, wherein said electron-emitting layer further comprises a support layer.

5. The field emission cathode structure of claim 1, further comprising on the tip side of the electron-emitting layer at least one electrically conductive material which is separated from said electron-emitting layer by at least one insulative material such that at least one of said emitter tip is exposed.

6. The field emission cathode structure of claim 5, wherein said electron-emitting layer is a multilayered structure.

7. The field emission cathode structure of claim 5, wherein at least one tip of said electron-emitting layer is a multilayered structure.

8. The field emission cathode structure of claim 5, wherein said electron-emitting layer further comprises a support layer.

9. The field emission cathode structure of claim 1, further comprising on the tip side of the electron-emitting layer a plurality of layers of electrically conductive material, each of which is separated from each other and said electron-emitting layer by at least one insulative material such that at least one of said emitter tip is exposed.

10. The field emission cathode structure of claim 9, wherein said electron-emitting layer is a multilayered structure.

11. The field emission cathode structure of claim 9, wherein at least one tip of said electron-emitting layer is a multilayered structure.

12. The field emission cathode structure of claim 9, wherein said electron-emitting layer further comprises a support layer.

13. The field emission cathode structure of claim 1, further comprising on the tip side of the electron-emitting layer at least one barrier layer, which is selectively removed to expose said tip.

14. The field emission cathode structure of claim 13, wherein said electron-emitting layer is a multilayered structure.

15. The field emission cathode structure of claim 13, wherein at least one tip of said electron-emitting layer is a multilayered structure.

16. The field emission cathode structure of claim 13, wherein said electron-emitting layer further comprises a support layer.

17. The field emission cathode structure of claim 1, wherein said tip has a coating of an electron-emitting material.

18. The field emission cathode structure of claim 1, wherein said tip is sharpened.

19. The field emission cathode structure of claim 1, wherein said tip is used as an electron source.

20. The field emission cathode structure of claim 1, wherein at least one tip is electrically isolated from another tip.

21. The field emission cathode structure of claim 1, wherein at least one tip is electrically connected to another electronic component.

22. The field emission cathode structure of claim 1, wherein said tip is used in an electronic display device.

23. The field emission cathode structure of claim 1, wherein said tip has a point or a blade profile.

24. The field emission cathode structure of claim 1, wherein said electron-emitting material is selected from a group comprising mo, W, Ta, Re, Pt, Au, Ag, Al, Cu, Nb, Ni, Cr, Ti, Zr, Hf and alloys thereof or solid solutions containing two or more of these elements.

25. The field emission cathode structure of claim 1, wherein said electron-emitting material is selected from a group comprising doped and undoped semiconductors.

26. The field emission cathode structure of claim 1, wherein said at least first material is a multilayered material.

27. The field emission cathode structure of claim 26, wherein at least one layer of said multilayered material is of a barrier material.

28. The field emission cathode structure of claim 1, wherein said structure has at least two cathodes and wherein at least a portion of one cathode is electrically isolated from a portion of the second cathode.

29. The field emission cathode structure of claim 1, wherein said structure has at least two cathodes and wherein at least a portion of one cathode is electrically connected to a portion of the second cathode.

30. A field emission cathode structure comprising at least one layer of material which is capable of emitting electrons under the influence of an electric field, and having at least one tip for the emission of electrons formed by the process comprising the steps of:

(a) forming at least one layer of an electrically conductive material over a base layer, (b) forming at least one hole at least through said at least one electrically conductive layer, (c) depositing at least one insulative material over said at least one electrically conductive layer and filling at least a portion of said hole sufficiently to form a cusp, (d) depositing at least one layer of a material which is capable of emitting electrons under the influence of an electrical field, over said at least one insulative material of step (c), and filling at least a portion of said cusp to form said at least one electron emitting layer, wherein said electron emitting layer has an upper surface and a lower surface, said upper surface having at least one secondary cusp, said lower surface having at least one tip, such that at least one tip is opposite said at least one secondary cusp, and wherein at least a portion of the surface of said tip is concave and wherein said at least one tip is used for the emission of said electrons, and (e) removing at least a portion of said material underneath said tip to expose at least a portion of said tip of said electron-emitting material and thereby forming said at least one field emission cathode structure.

31. The field emission cathode structure of claim 30, wherein said electron-emitting material is selected from a group comprising Mo, W, Ta, Re, Pt, Au, Ag, Al, Cu, Nb, Ni, Cr, Ti, Zr, Hf and alloys thereof or solid solutions containing two or more of these elements.

32. The field emission cathode structure of claim 30, wherein said insulating material is selected from a group comprising sapphire, glass or oxides of Si, Al, Mg and Ce.

33. The field emission cathode structure of claim 30, wherein said electron-emitting material is selected from a group comprising doped and undoped semiconductors.

34. The field emission cathode structure of claim 30, wherein said at least one insulative material is a multilayered material.

35. The field emission cathode structure of claim 34, wherein at least one layer of said multilayerd material is of a barrier material.

36. The field emission cathode structure of claim 30, wherein said structure has at least two cathodes and wherein at least a portion of one cathode is electrically isolated from a portion of the second cathode.

37. The field emission cathode structure of claim 30, wherein said structure has at least two cathodes and wherein at least a portion of one cathode is electrically connected to a portion of the second cathode.

38. The field emission cathode structure of claim 30, wherein at least a portion of said at least one insulative material covering the wall surface of at least one of said electrically conductive material adjacent said exposed electron-emitting material is removed.

39. A field emission cathode structure comprising at least one layer of material which is capable of emitting electrons under the influence of an electric field, and having at least one tip for the emission of electrons formed by the process comprising the steps of:

(a) forming a plurality of layers of electrically conductive material over a base layer, such that each said layer of electrically conductive material is separated by an insulative material, (b) forming at least one hole at least through said electrically conductive layers, (c) depositing at least one insulative material over said layers of electrically conductive material and filling at least a portion of said hole sufficiently to form a cusp, (d) depositing at least one layer of a material which is capable of emitting electrons under the influence of an electrical field, over said insulative material of step (c), and filling at least a portion of said cusp to form said at least one electron emitting layer, wherein said electron emitting layer has an upper surface and a lower surface, said upper surface having at least one secondary cusp, said lower surface having at least one tip, such that at least one tip is opposite said at least one secondary cusp, and wherein at least a portion of the surface of said tip is concave and wherein said at least one tip is used for the emission of said electrons, and (e) removing at least a portion of material underneath said tip to expose at least a portion of said tip of said electron-emitting material and thereby forming said at least one field emission cathode structure.

40. The field emission cathode structure of claim 39, wherein said electron-emitting material is selected from a group comprising mo, W, Ta, Re, Pt, Au, Ag, Al, Cu, Nb, Ni, Cr, Ti, Zr, Hf and alloys thereof or solid solutions containing two or more of these elements.

41. The field emission cathode structure of claim 39, wherein said insulating material is selected from a group comprising sapphire, glass or oxides of Si, Al, Mg and Ce.

42. The field emission cathode structure of claim 39, wherein said electron-emitting material is selected from a group comprising doped and undoped semiconductors.

43. The field emission cathode structure of claim 39, wherein said at least one insulative material is a multilayered material.

44. The field emission cathode structure of claim 43, wherein at least one layer of said multilayered material is of a barrier material.

45. The field emission cathode structure of claim 39, wherein said structure has at least two cathodes and wherein at least a portion of one cathode is electrically isolated from a portion of the second cathode.

46. The field emission cathode structure of claim 39, wherein said structure has at least two cathodes and wherein at least a portion of one cathode is electrically connected to a portion of the second cathode.

47. The field emission cathode structure of claim 39, wherein at least a portion of said at least one insulative material covering the wall surface of at least one of said electrically conductive material adjacent said exposed electron-emitting material is removed.

48. A field emission cathode structure comprising at least one layer of material which is capable of emitting electrons under the influence of an electric field, and having at least one tip for the emission of electrons, wherein said electron emitting layer has an upper surface and a lower surface, said upper surface having at least one secondary cusp, said lower surface having at least one tip, such that at least one tip is opposite said at least one secondary cusp, and wherein at least a portion of the surface of said tip is concave and wherein said at least one tip is used for the emission of said electrons, and thereby forming said at least one field emission cathode structure.

49. The field emission cathode structure of claim 48, wherein said electron-emitting material is selected from a group comprising Mo, W, Ta, Re, Pt, Au, Ag, Al, Cu, Nb, Ni, Cr, Ti, Zr, Hf and alloys thereof or solid solutions containing two or more of these elements.

50. The field emission cathode structure of claim 48, wherein said electron-emitting material is selected from a group comprising doped and undoped semiconductors.

51. The field cathode structure of claim 48, wherein said tip has a point or a blade profile.

* * * * *